US006056580A

United States Patent [19]

Cross et al.

[11] Patent Number: 6,056,580

[45] Date of Patent: May 2, 2000

[54] ELECTRICAL PLUG AND CORD STRAIN RELIEF AND COUPLING DEVICE

[75] Inventors: Andrew L. Cross, Mantua; Thomas J. Luby, Akron, both of Ohio

[73] Assignee: The Dzyne Group, Ltd., Akron, Ohio

[21] Appl. No.: 09/046,832

[22] Filed: Mar. 24, 1998

Related U.S. Application Data

[62] Division of application No. 08/634,143, Apr. 19, 1996, Pat. No. 5,785,547.

[51] Int. Cl.[7] ..... H01R 13/62

[52] U.S. Cl. ..... 439/369

[58] Field of Search ..... 439/367, 369–373

[56] References Cited

U.S. PATENT DOCUMENTS

| | | | |
|---|---|---|---|
| 2,291,793 | 8/1942 | Chandler | 173/328 |
| 4,204,738 | 5/1980 | Tillotson . | |
| 4,457,571 | 7/1984 | Lavine et al. . | |
| 4,652,069 | 3/1987 | Smith . | |
| 4,840,577 | 6/1989 | Prouty | 439/373 |
| 4,875,874 | 10/1989 | Windsor, Jr. | 439/369 |
| 4,940,424 | 7/1990 | Odbert | 439/369 |
| 5,011,427 | 4/1991 | Martin | 439/373 |
| 5,104,335 | 4/1992 | Conley et al. | 439/369 |
| 5,179,044 | 1/1993 | Muromachi et al. | 439/369 |
| 5,211,573 | 5/1993 | Cross | 439/369 |
| 5,217,387 | 6/1993 | Hull et al. | 439/367 |
| 5,249,337 | 10/1993 | Cross et al. | 24/129 R |
| 5,259,782 | 11/1993 | Giffin | 439/367 |
| 5,273,454 | 12/1993 | Shotey | 439/367 |
| 5,306,176 | 4/1994 | Coffey | 439/367 |
| 5,328,384 | 7/1994 | Magnuson | 439/369 |
| 5,334,042 | 8/1994 | Chevalier | 439/369 |
| 5,336,106 | 8/1994 | Osten | 439/369 |
| 5,336,107 | 8/1994 | Sheryll | 439/369 |
| 5,342,212 | 8/1994 | Francis | 439/149 |
| 5,382,179 | 1/1995 | Noschese | 439/533 |
| 5,393,243 | 2/1995 | Carmo | 439/369 |
| 5,584,720 | 12/1996 | Elswick | 439/369 |

*Primary Examiner*—Khiem Nguyen
*Attorney, Agent, or Firm*—Renner, Kenner, Greive, Bobak, Taylor, & Weber

[57] ABSTRACT

A system (21) for holding a cord (28, 58) includes a retention device (20) which is adapted to engage a number of elements such as a hooded plug head (22), a handle of a power tool (51), a retainer (62) or a cleat (101). The device (20) includes spaced arms (25, 26) which engage the elements (22, 51, 62 or 101). In the embodiment wherein the element is the hooded plug head (22), the arms (25, 26) may have lugs (38, 39) thereon to engage apertures (42, 43) of the plug head (22) or the arms (25, 26) may be provided with apertures (47, 48) to receive lugs (49) formed on the plug head (22). The lugs (38, 39) and apertures (42, 43) are of the same general predetermined configuration so that when they are aligned with each other, the lugs (38, 39) can pass through the apertures (42, 43) but can thereafter be misaligned so that the device (20) is attached to the plug head (22).

14 Claims, 7 Drawing Sheets

ELECTRICAL PLUG AND CORD STRAIN RELIEF AND COUPLING DEVICE

CROSS REFERENCE TO RELATED APPLICATION

This is a division of application Ser. No. 08/634,143, filed Apr. 19, 1996, now U.S. Pat. No. 5,785,547 which is incorporated herein by reference.

TECHNICAL FIELD

This invention relates to a device which prevents strain on electrical cord and plug connections and which maintains a plug engaged to a mating connector. More particularly, this invention relates to such a device which can be universally used in a variety of environments such as to maintain a connection to an outdoor power tool, to maintain the connection with an extension cord, and the like.

BACKGROUND ART

There are a wide variety of devices available which hold mating male and female plug heads coupled together. However, most of these devices do not provide strain relief for the cord-to-head connection. There are some devices available on the market today which do reduce strain in electrical cords while otherwise maintaining the coupling between mating male and female plugs. Probably one of the best designs for such a device is shown in U.S. Pat. No. 5,211,573. There, dependent on the application, variously configured devices are disclosed. Where mating male and female plugs are to be retained, the elongate device has a retention member on each end thereof which secures each of the interconnected cords with the plugs positioned therebetween. However, in order to accommodate plugs or outlets of differing configurations, for example, the plug of an outdoor tool, a differently configured device is required. Thus, the need exists to provide a single device which can be universally used in most all electrical coupling circumstances.

SUMMARY OF THE INVENTION

It is thus an object of the present invention to provide a device which not only maintains mated male and female plug connectors together but also produces cord strain relief so that the electrical cord cannot be pulled out of the plugs.

It is another object of the present invention to provide a device, as above, which can be provided in a single general configuration and yet which can be universally applied to all types of connectors such as conventional cords, outdoor power tool receptacles and the like.

It is a further object of the present invention to provide a device, as above, which can be easily assembled with the connectors and also be readily removed therefrom, if desired.

It is an additional object of the present invention to provide a device, as above, which can be stored on one of the cords when not in use.

It is yet another object of the present invention to provide a device, as above, which is easily and inexpensively manufactured out of a plastic material.

These and other objects of the present invention, as well as the advantages thereof over existing prior art forms, which will become apparent from the description to follow, are accomplished by the improvements hereinafter described and claimed.

In general, a system for holding a cord-like member made in accordance with the concepts of the present invention includes a retention device which is adapted to engage another element. The retention device has spaced arms and a grip slot between the arms to engage the cord-like member. One of either the element or the arms has lugs positioned thereon and the other of either the element or the arms has apertures formed therein. The lugs and apertures are generally of the same predetermined configuration and when they are aligned with each other, the lugs can pass through the apertures. Thereafter, they can be misaligned so that the device is attached to the element.

Preferred exemplary devices incorporating the concepts of the present invention are shown by way of example in the accompanying drawings without attempting to show all the various forms and modifications in which the invention might be embodied, the invention being measured by the appended claims and not by the details of the specification.

PREFERRED EMBODIMENTS FOR CARRYING OUT THE INVENTION

Figure 1:
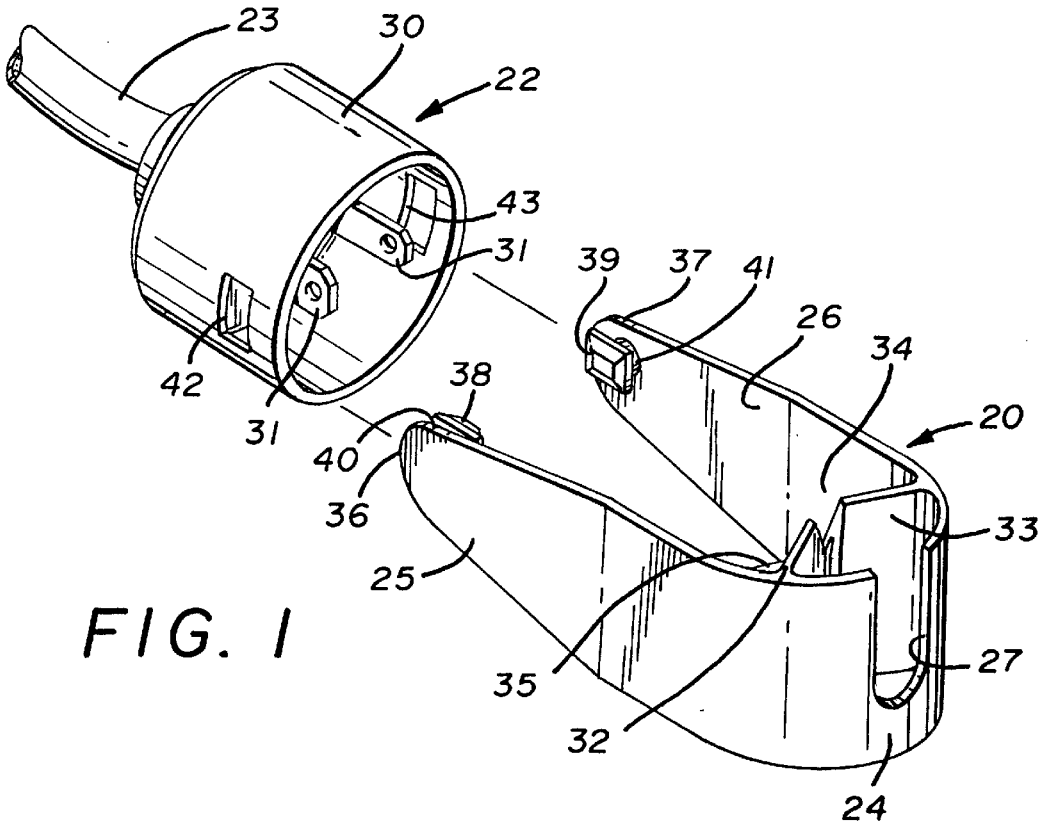
FIG. 1 is an exploded perspective view of a device made in accordance with the concepts of the present invention and shown as being used with a hooded plug head of the type commonly found in outdoor power tools.

A retaining or coupling device made in accordance with the present invention is indicated generally by the numeral 20 in the drawings. Device 20 is common to all of the systems disclosed herein and as shown in FIGS. 1–5, one of the systems, generally indicated by the numeral 21, involves the manner in which device 20 may be associated with a hooded plug head, generally indicated by the numeral 22, of the type commonly found at the end of a usually short cord 23 of a power tool (not shown).

Retaining or coupling device 20 is preferably conveniently formed of an acrylonitrile-butadiene-styrene copolymer (ABS) or equivalent plastic material having good memory characteristics and able to withstand a wide temperature range. Device 20 is generally U-shaped in configuration having a face 24 at one end thereof and two longitudinally spaced arms 25, 26 extending from the edges of face 24. Face 24 can be rounded, as shown in FIG. 1, or flat as shown in other embodiments (see FIG. 9) to be hereinafter described. Whatever its profile, face 24 is preferably provided with a slot 27 therein through which a cord 28 which carries an electrical plug connector 29 may freely slidably pass. Cord 28 would typically be an extension cord utilized by the user of the power tool to provide power to the tool at a remote location, and connector 29 is received within the hood 30 of plug head 22 to engage the electrical prongs 31 recessed therein.

Figure 4:
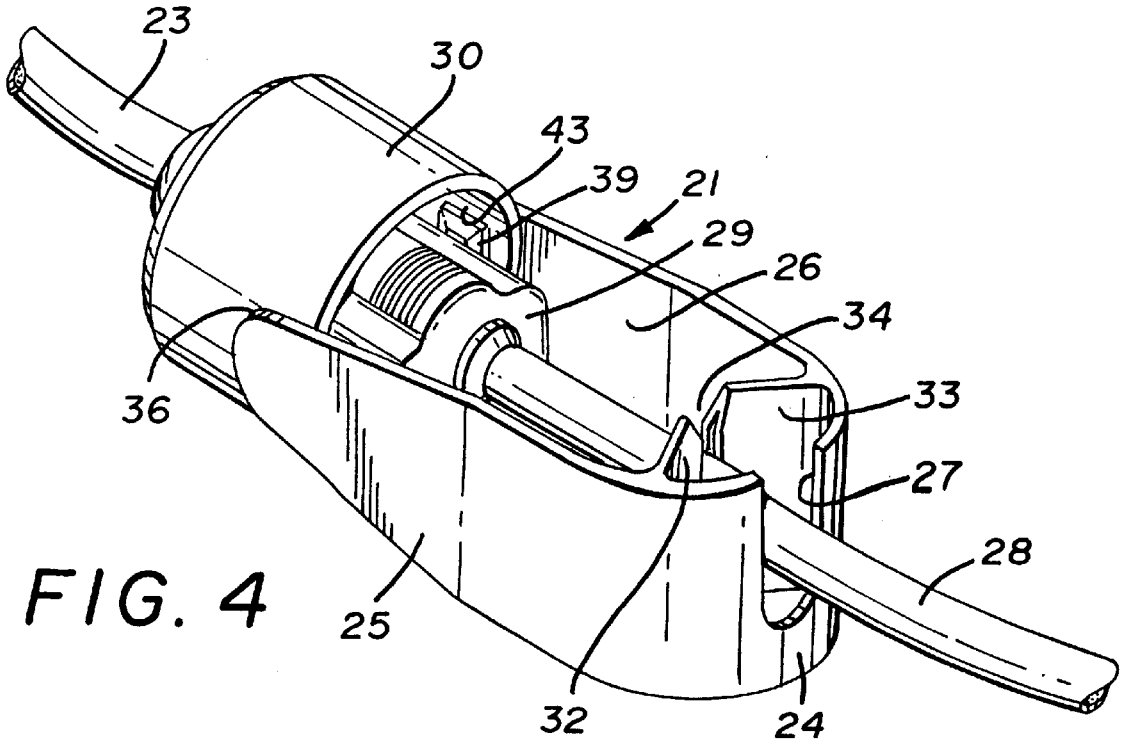
FIG. 4 is a perspective view similar to FIG. 3 but showing a plug and cord being held in place within the device.

To maintain the connection between plug head 22 and connector 29, device 20 is provided with a retention device near and adjacent to face 24, which retention device can be identical to that shown and described in U.S. Pat. No. 5,211,573 to which reference is made, as necessary, for a more complete understanding of the present invention. Thus, the retention device includes flexible filaments or rib-like members 32, 33 extending inwardly from arms 25, 26, respectively, but stopping just short of physically intersecting to form a slot opening 34. As shown in FIG. 4, when system 21 is assembled with connector 29 and cord 28 therein, cord 28 is clamped between or otherwise engaged in slot opening 34 by members 32 and 33. Thus, the strain caused by any pulling on cord 28 is not transmitted to connector 29, but rather is absorbed by members 32 and 33.

Figure 2:
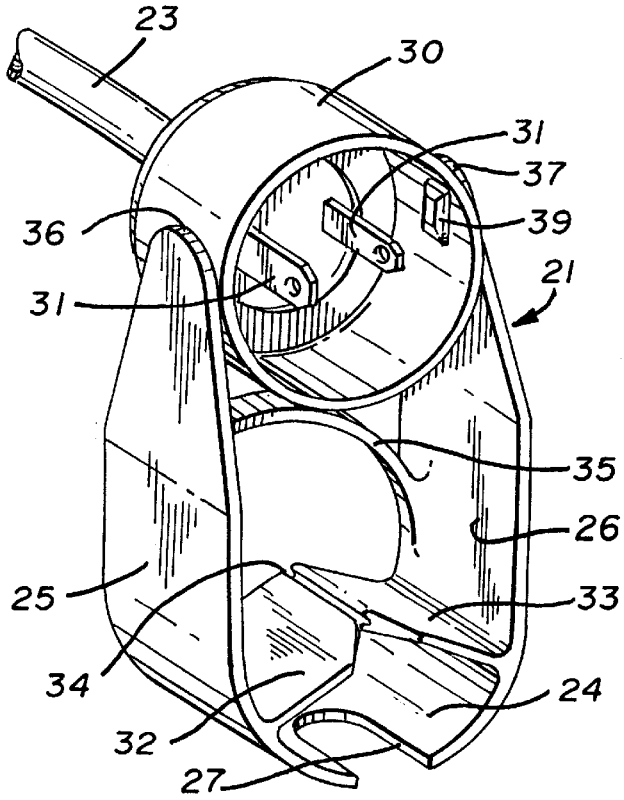
FIG. 2 is a perspective view of the device of FIG. 1 showing the initial step of attaching it to the plug head.
Figure 3:
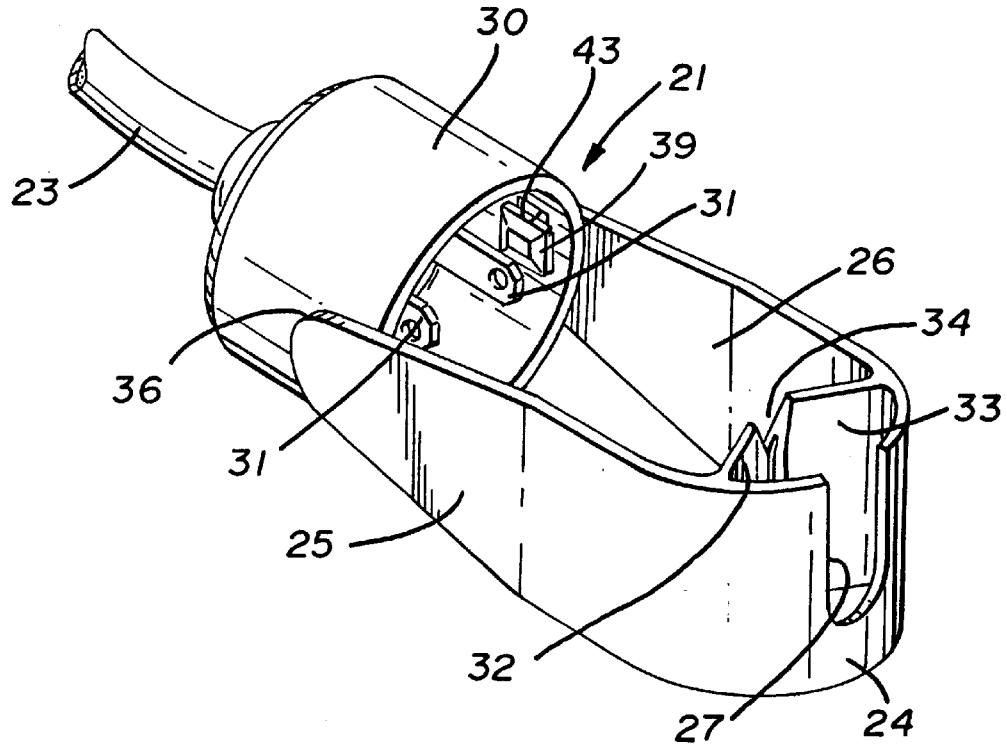
FIG. 3. is a perspective view of the device of FIG. 1 showing the device rotated 90° from the FIG. 2 position and thereby being locked in place and the system being ready for use.

Because of the resilient nature of the plastic material, arms 25, 26 are moveable relative to each other and can be provided with a degree of rigidity at the end near face 24 by ribbing 35, best shown in FIG. 2, extending between arms 25 and 26. But otherwise, arms 25 and 26 normally have their other ends, 36 and 37, respectively, biased inwardly and thus positioned close to each other, but they can be spread apart, as shown in FIG. 1, to be attached to plug head 22 in a manner now to be described.

Ends 36, 37 of arms 25, 26 are provided with inwardly directed lugs 38, 39, respectively, which thus face each other and are opposed to each other. Lugs 38, 39 are carried on stems 40, 41, respectively, and are adapted to be received in apertures 42, 43 formed in hood 30 of plug head 22. While the exact shape or configuration of lugs 38, 39 and apertures 42, 43 is not critical, as will now be explained, the configuration should be the same, cannot be circular, and must be oriented differently on the arms 25, 26 than on the hood 30. Thus, as shown, lugs 38, 39 can be rectangular in configuration having their larger edge longitudinally aligned with arms 25, 26 or, stated another way, axially aligned with the cylindrical hood 30. Apertures 42, 43 would also then be rectangular and of the same size, but cannot have their longer edge axially or longitudinally aligned with lugs 38, 39. Rather, apertures 42, 43 must have their longer edge positioned at some predetermined angle, preferably 90°, to the longer edge of lugs 38, 39. Such an arrangement assures that device 20 will be locked onto hooded plug head 22 in the operable position as now will be described.

In order to mount device 20 on plug head 22, first arms 25, 26 are spread away from each other and device 20 is positioned relative to head 22 so that the configuration of lugs 38, 39 is aligned with the configuration of apertures 42, 43. For the rectangular configuration shown, one of two such positions is shown in FIG. 2. In this position, lugs 38, 39 may extend through apertures 42, 43. Then, by rotating device 20 a predetermined distance, in this instance 90°, apertures 42, 43 will turn on stems 40, 41 and the configuration of lugs 38, 39 will be misaligned with the configuration of apertures 42, 43. In this position, device 20 cannot be removed from plug head 22. The inward bias of arms 25, 26 also maintain system 21 in the FIG. 3 position, that is, with device 20 axially or longitudinally aligned with plug head 22.

In such a position, the connector 29 and cord 28 can be inserted, as shown in FIG. 4, and as previously described, and connector 29 is secured to plug head 22 and cannot be accidentally removed therefrom. Moreover, because of retaining filaments 32, 33, no stress can be placed on the connection between cord 28 and connector 29.

Device 20, when the electrical appliance or tool is not in use, can be readily removed from plug head 22, if desired, by simply rotating it 90°, clockwise or counterclockwise, thus aligning the configuration of lugs 38, 39 with that of apertures 42, 43. The lugs 38, 39 may then be pulled through apertures 42, 43 by spreading arms 25, 26 apart. If it is desired not to remove device 20 from plug head 22 when the tool or appliance is not in use, device 20 may be rotated 180° from the FIG. 3 position to the FIG. 5 position and opening 34 between filaments 32 and 33 can grip cord 23 of the tool to store device 20 with the tool until the next time that the tool is used.

Figure 6:
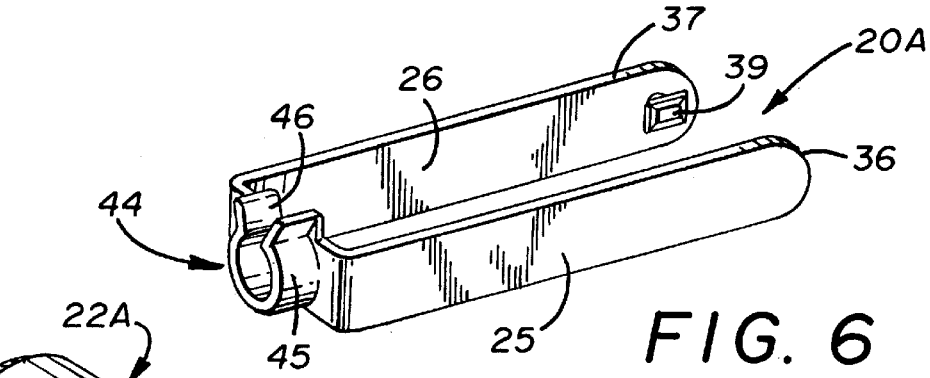
FIG. 6 is a perspective view of a device made in accordance with the concepts of the present invention and having a different cord holding mechanism.

The preferred system 21 with its unique device 20 to be coupled with hooded plug head 22 has been described hereinabove. However, several modifications could be made to the system without departing from the concepts of the invention. For example, the exact retention device utilizing the filaments 32, 33 as shown in detail in U.S. Pat. No. 5,211,573, does not need to be utilized in order to accomplish the objects of the present invention. Rather, any suitable cord retention device may be utilized. One such alternative device, generally indicated by the numeral 20A, is shown in FIG. 6 and includes a retention device generally indicated by the numeral 44. Retention device 44 is generally keyhole shaped and includes a generally circular cord receiving area 45 opening into a clip-like cord entrance slot area 46. Thus, cord 28 may be snapped into receiving area 45 by passing it through slot area 46 and the device 20A of FIG. 6 can thus be utilized in the exact manner as device 20 previously described.

Figure 7:
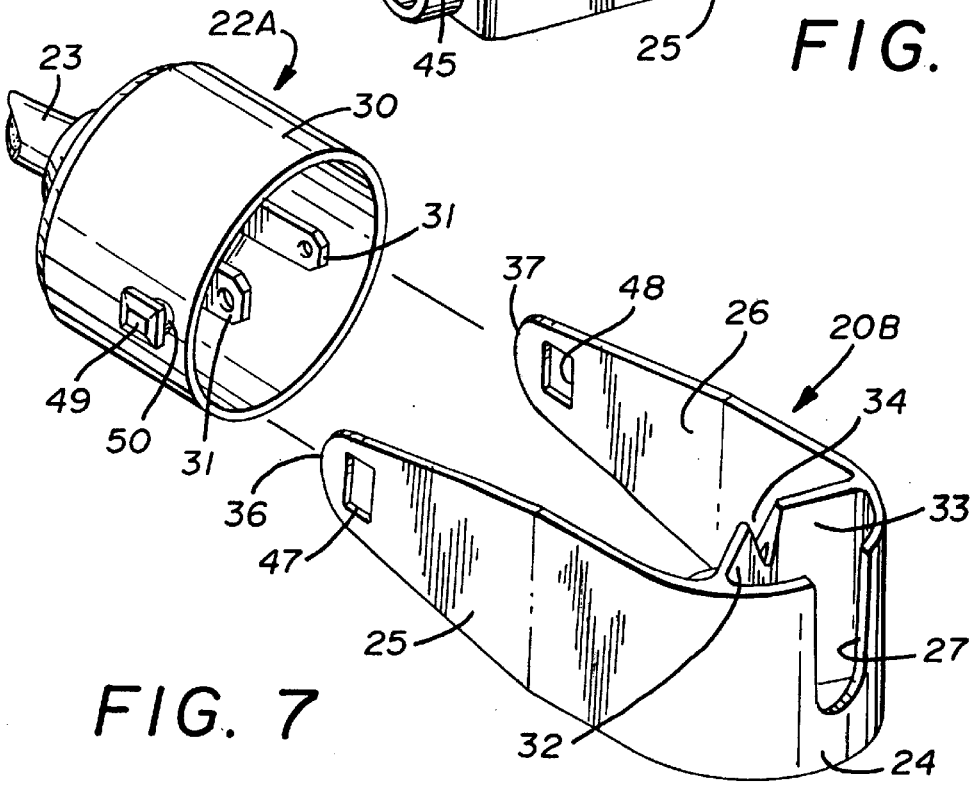
FIG. 7 is an exploded perspective view similar to FIG. 1 but showing an alternative connecting mechanism between the device and the plug wherein the components are reversed.

Another alternative form of device 20 is shown in FIG. 7 and generally indicated by the numeral 20B. In this embodiment, the positioning of the lugs and the apertures is reversed, that is, arms 25, 26 are provided with apertures 47, 48, respectively, (equivalent to apertures 42, 43) which are engaged by lugs 49 (one shown) carried by stems 50 on hood 30 of plug 22A. Other than this reversal in the positioning of the lugs and apertures, the manner in which device 20B attaches to hood plug 22A and the importance of the configuration and orientation of the lugs and apertures is the same as described with respect to device 20 and plug 22.

Figure 8:
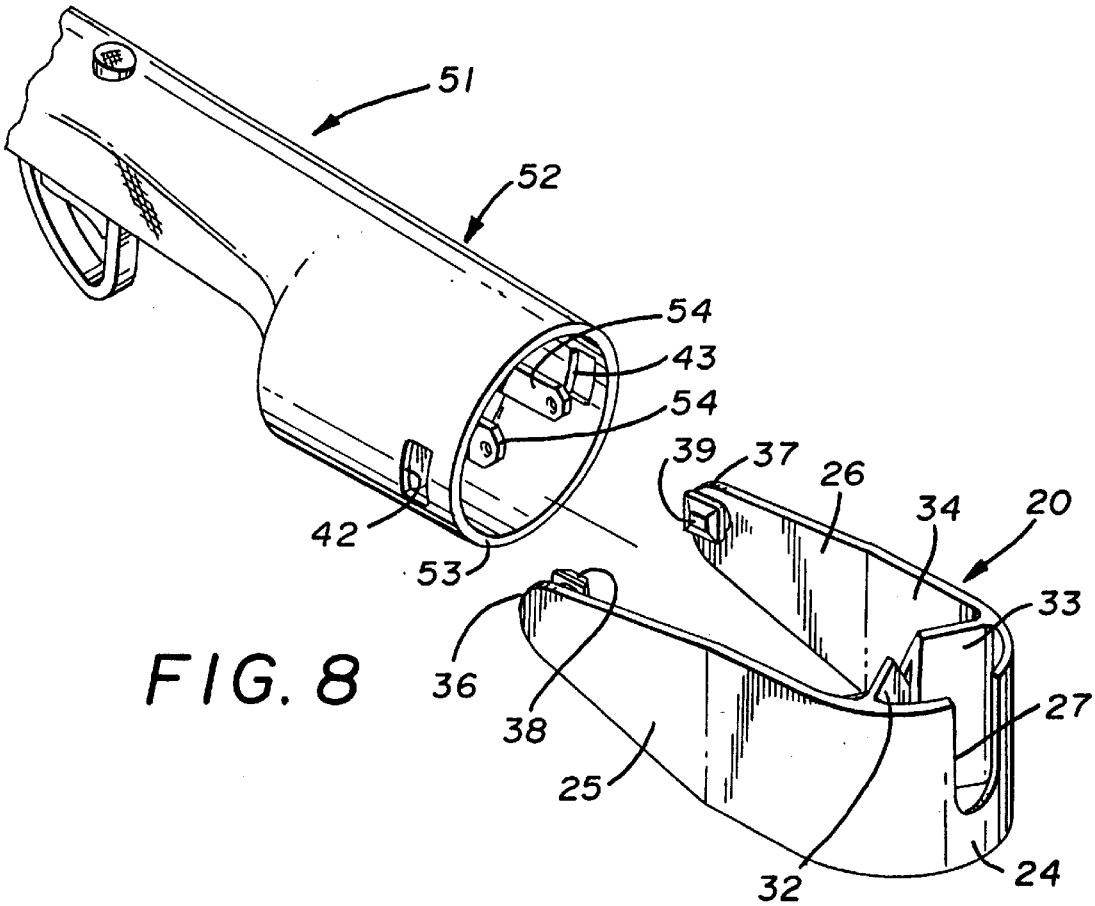
FIG. 8 is an exploded perspective view of a device made in accordance with the concepts of the present invention and shown as being used with a receptacle which is built into the handle of a power tool.

Some power tools do not utilize a hooded plug head 22 carried by a cord 23. Rather, the connector is built directly into the power tool, usually at the end of the handle thereof. The device 20 of the present invention can be adapted to such an arrangement as shown in FIG. 8. There the handle of a power tool, somewhat schematically shown and generally indicated by the numeral 51, itself carries a hooded connector generally indicated by the numeral 52 and having a hood 53 with electrical prongs 54 recessed therein. Just as was the case with hood 30, hood 53 is provided with the diametrically opposed apertures 42, 43 to receive lugs 38, 39, respectively, of device 20. Thus, the manner in which device 20 may be attached and locked to power tool handle 51 is exactly as has been described relative to system 21. Moreover, of course, device 20 may be modified as shown in FIG. 6 in this embodiment as well, and the possible reversal of the lugs and apertures, as shown in FIG. 7, also apply to the FIG. 8 embodiment.

Figure 9:
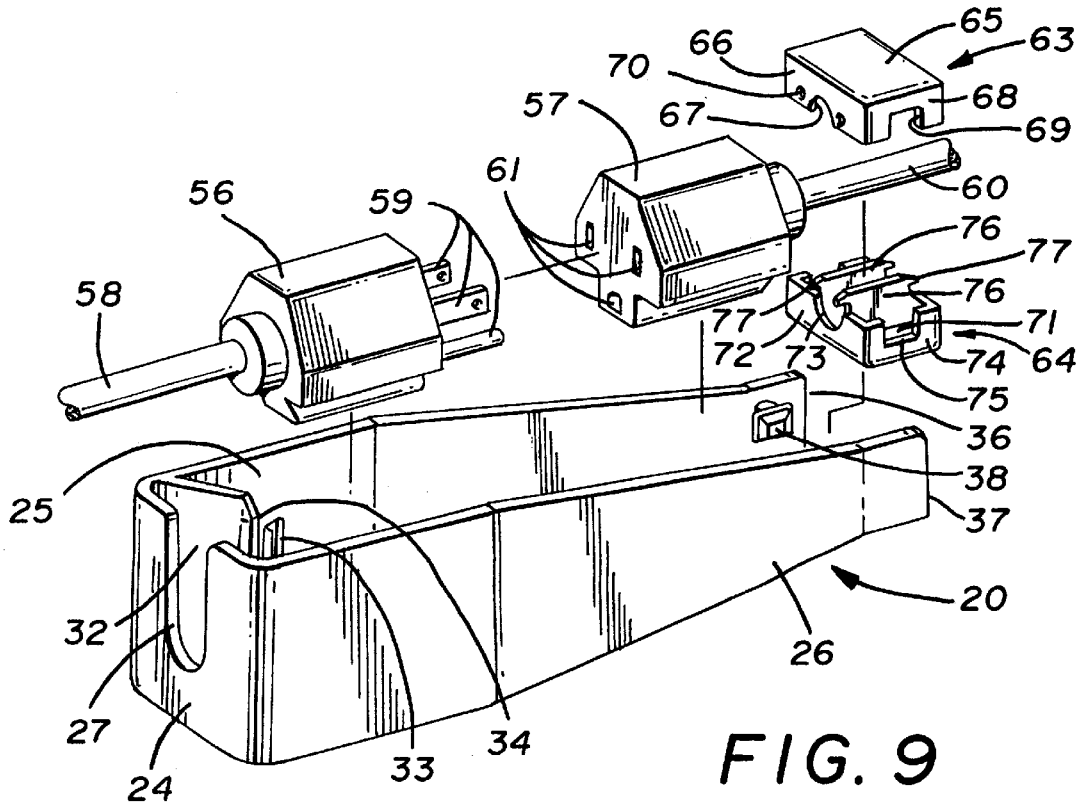
FIG. 9 is an exploded perspective view of a device made in accordance with the concepts of the present invention and shown as being used with a cord retainer to hold mating male and female plug connectors.
Figure 10:
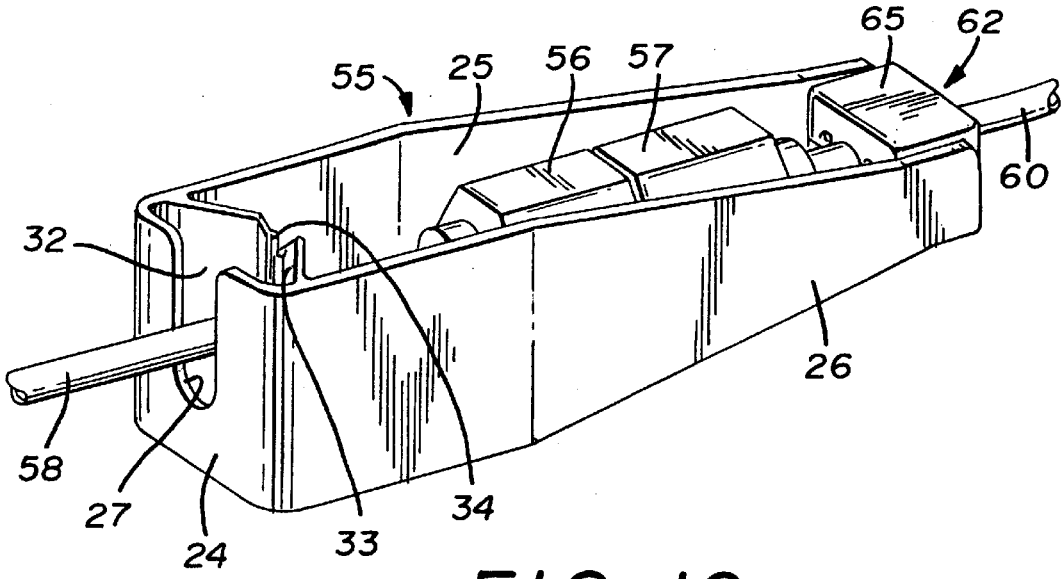
FIG. 10 is a perspective view of an assembled system shown in FIG. 9.

Device 20 is not solely adaptable for use in system 21 with outdoor power tools and the like. Rather, as shown in FIGS. 9 and 10, device 20 may be used in a system generally indicated by the numeral 55 to couple two electric cords. As shown, device 20 can be essentially identical to that shown in the FIG. 1 embodiment or could be modified as shown in FIGS. 6 and/or 7.

In either event, in system 55, device 20 is adapted to hold mating male and female connector heads 56 and 57, respectively. Male connector 56 is carried by cord 58 and has the conventional electrical prongs 59. Female connector 57 is carried by cord 60 and has the conventional sockets 61 to receive prongs 59. Depending on the relative positioning of connectors 56 and 57, either cord 58 or cord 60 is received through grip opening 34 and engaged by filaments 32, 33. As shown in FIGS. 9 and 10, it is cord 58 which is so retained.

The other cord, in this instance cord 60, is engaged by a retainer, one embodiment of which is generally indicated by the numeral 62 and shown in FIGS. 9 and 10. Retainer 62 is formed from two sections or halves, one half being generally indicated by the numeral 63 and the other by the numeral 64. Retainer half 63 includes an upper surface 65, opposed sidewalls 66 having a radiused notch 67 therein, and opposed end walls 68 having a linear notch 69 therein. Sidewalls 66 are also provided with a plurality of pin-receiving apertures 70 therein. Retainer half 63 is open at the bottom.

Retainer half 64 is open at the top and includes a bottom surface 71, opposed sidewalls 72 extending upwardly therefrom and having a radiused notch 73 therein, and opposed end walls 74 having a linear notch 75 therein. A pair of ribs 76 extending upwardly from bottom surface 71 and between sidewalls 72, and carry pins 77 at the upper outer edges thereof.

Retainer 62 is assembled on cord 60 (or cord 58, as previously described) by placing it either in notch 67 or notch 73 and closing retainer half 63 on container half 64 until they are locked together when pins 77 are received in apertures 70. The circular socket formed by notches 67 and 73 is designed to be of a size to engage and hold the conventional cord 60 but, of course, could be made larger or smaller dependent on the cord size. The rectangular apertures formed by the adjacent linear notches 69 and 75 receive the lugs 38, 39 of device 20 in the same fashion that plug head 22 of FIG. 1 receives the lugs, as previously described. Moreover, it should be evident that the apertures formed by notches 69 and 75 could be replaced by lugs to receive the apertures 47, 48 of retaining device 20B (FIG. 7).

Figure 5:
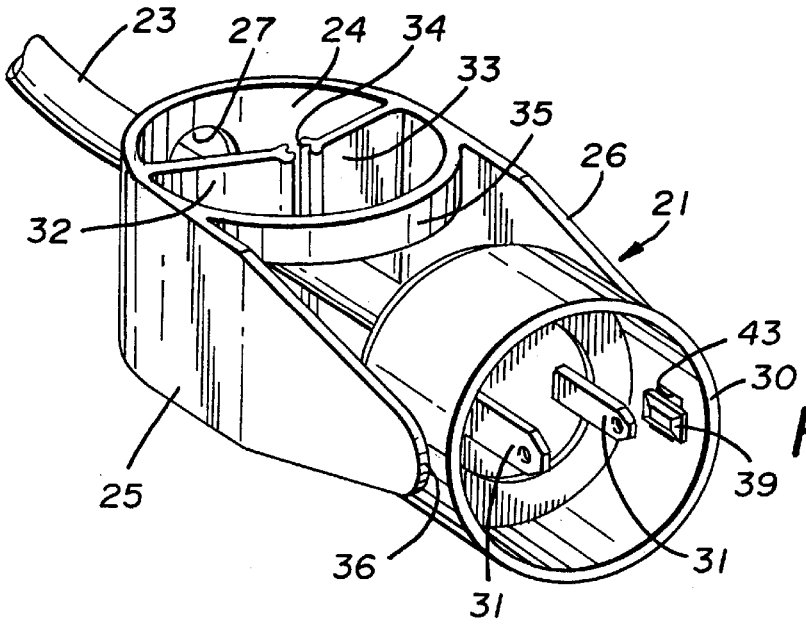
FIG. 5 is a perspective view of the device of FIG. 1 showing the device rotated 180° from the FIG. 3 position for storage on the cord which carries the hooded plug head.

For storage purposes, device 20 may be removed from its engagement of cord 58 and retainer 62, and retainer 62 may be left on cord 60 or removed therefrom, as desired. If retainer 62 stays on cord 60, device 20 may be rotated 180° and stored on cord 60 as shown in FIG. 5.

Figure 13:
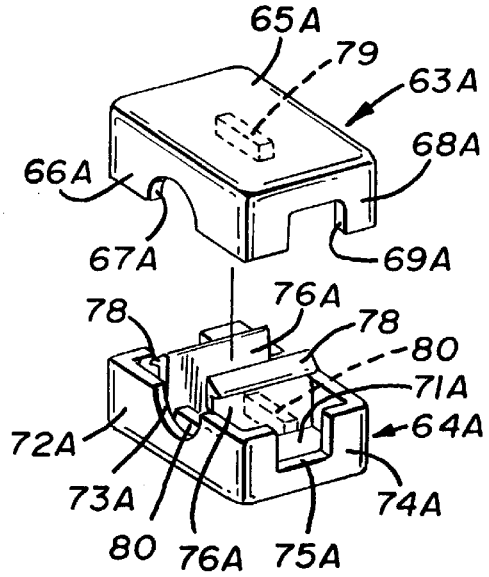
FIG. 13 is an exploded perspective view of another embodiment of a retainer of the type used in conjunction with the system of FIGS. 9 and 10.
Figure 14:
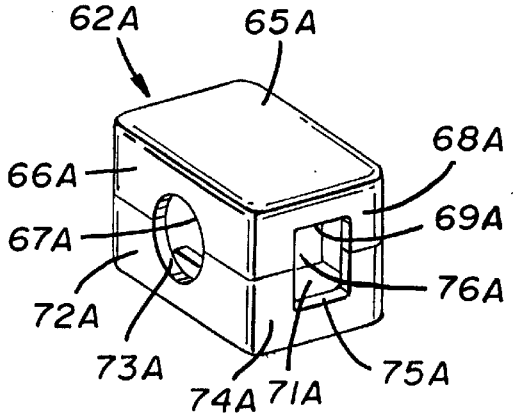
FIG. 14 is a perspective view of the retainer of FIG. 13 shown in a closed position.
Figure 15:
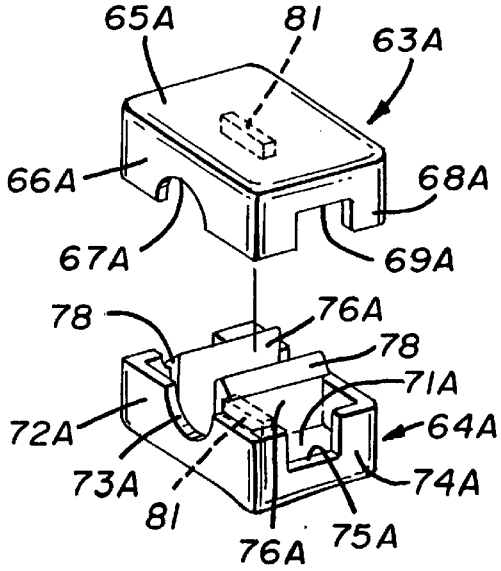
FIG. 15 is an exploded perspective view of yet another embodiment of a retainer of the type used in conjunction with the system of FIGS. 9 and 10.

Alternative two piece embodiments of retainer 62 are shown in FIGS. 13 and 15, and shown assembled in FIG. 14 as retainer 62A. In these embodiments, components which are generally identical to the components of retainer 62 have been given like reference numerals followed by the suffix A, and will not be re-described herein. The main differences between retainers 62 and 62A are two-fold. First, halves 63A and 64A are not connected by means of pins 77 in apertures 70. Rather, hooks 78 are formed on top of ribs 76A and are received in openings (not shown) formed beneath upper surface 65A.

Second, the aperture formed by adjacent notches 76A and 73A is not relied upon to provide the total clamping force on a cord. In fact, because of the different clamping mechanisms of the embodiments of FIGS. 13 and 15, the aperture formed by notches 67A and 73A can be made larger so that retainer 62A can move universally to grasp more conventional sizes of cords. In FIG. 13, a lug 79 extends downwardly from upper surface 65A, generally centrally thereof, and a pair of spaced lugs 80 extend upwardly from bottom surface 71A. Lug 79 and lugs 80 are relatively positioned so that when retainer 62A is assembled, lug 79 is generally midway between lugs 80. Together, lugs 79 and 80 can engage the cord passing through the aperture formed by notches 67A and 73A, and retainer 62A can thereby accommodate cords having sizes other than sizes slightly larger than the aperture formed by mating notches 67 and 73. It has also been found that single opposed lugs 81, such as shown in the embodiment of FIG. 15, will serve to clamp cords of slightly varying diameters.

Figure 11:
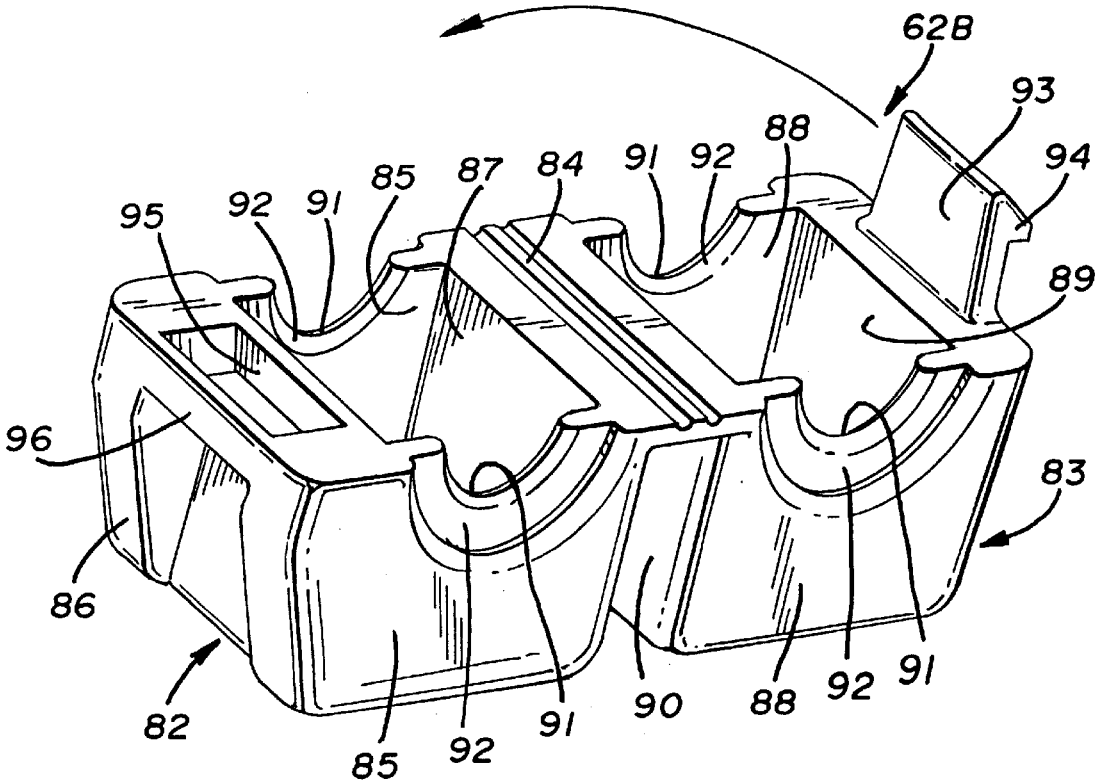
FIG. 11 is a perspective view of another embodiment of a retainer of the type used in conjunction with the system of FIGS. 9 and 10, and shown in an open position.
Figure 12:
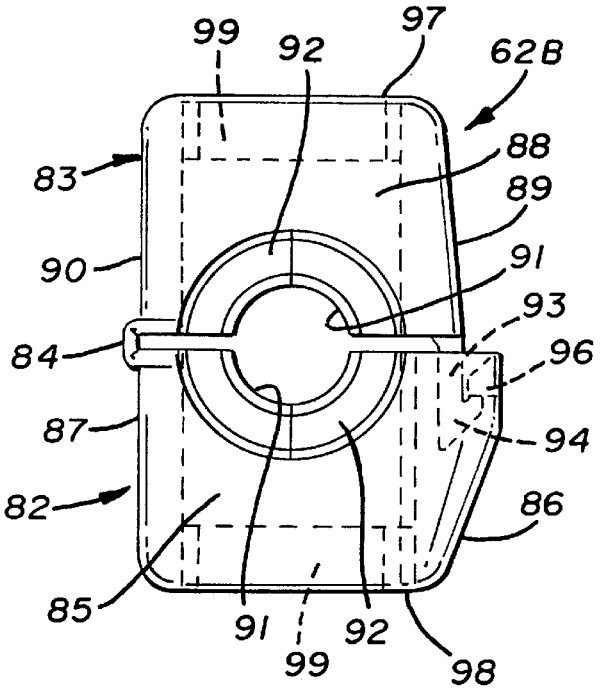
FIG. 12 is an elevational view of the retainer of FIG. 11 shown in the closed position.

Retainer 62, instead of being formed from two separate halves, may be provided as one piece. Such is shown in FIGS. 11 and 12 and indicated generally by the numeral 62B. In this embodiment, a first section of retainer 62B, generally indicated by the numeral 82, is connected to a second section, generally indicated by the numeral 83, by a living hinge 84.

As oriented in the position shown in FIG. 11, section 82 includes generally identical opposed sidewalls 85 and opposed end walls 86, 87. Section 83 includes generally identical opposed sidewalls 88 and opposed end walls 89,90. Sidewalls 85 and 88 each have a generally semicircular notch 91 formed therein to receive and engage a cord when section 83 is folded onto section 82 as shown in FIG. 12. The majority of sidewalls 85 and 88 are formed of a rigid plastic but a portion thereof adjacent to each notch 91, and designated by the numeral 92, is thinned out and flexible. This is desirable so that mating notches 91 can accommodate and grip cords of various sizes with portion 92 of sidewalls 85 and 88 flexing more for cords of larger diameter. Also, if desired, one or more ribs could extend between end walls 86 and 87 and end walls 89 and 90. These ribs would be parallel to sidewalls 85 and 88 and would have notches and thinned out flexible portions therein, just like notches 91 and portions 92, for further gripping of the cord, if necessary.

Extending outwardly from and generally parallel to end wall 89 of section 83 is a lug 93 having a lock barb 94 on the end thereof. An edge of end wall 86 of section 82 has a recess 95 therein partially defined by a lock bar 96. When section 83 is folded onto section 82 on hinge 84 which connects end walls 87 and 90, lug 93 is received through recess 95 until barb 94 engages bar 96 as shown in FIG. 12. This locks retainer 62B in place on the cord (not shown) within the aperture defined by adjacent notches 91. Such connection can be released, if desired, by applying pressure to barb 94 until it releases bar 96.

The upper wall 97 and the lower wall 98 of retainer 62B, as viewed in FIG. 12, are provided with the rectangular openings 99 which receive, for example, lugs 38, 39 of a device 20. Or, of course, walls 97 and 98 could alternatively be provided with lugs to be engaged by the apertures 47 and 48 of a device 20B.

Figure 16:
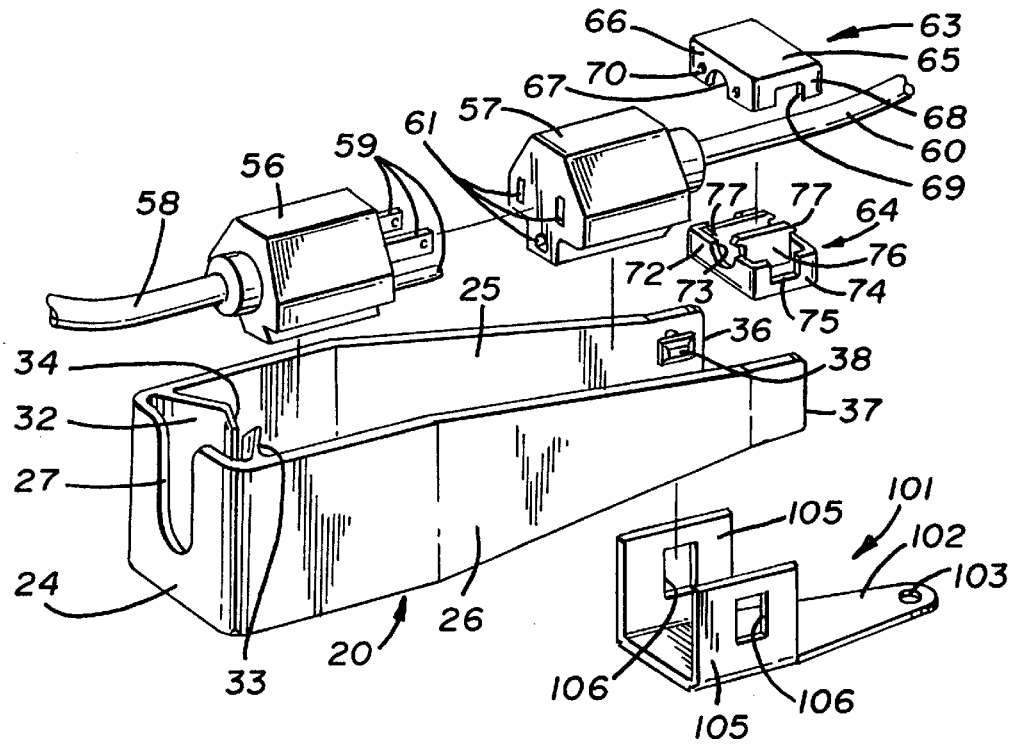
FIG. 16 is an exploded perspective view of a system similar to that shown in FIGS. 9 and 10 but showing its adaptation to be used with a cleat so that it may be held in place on a surface.
Figure 17:
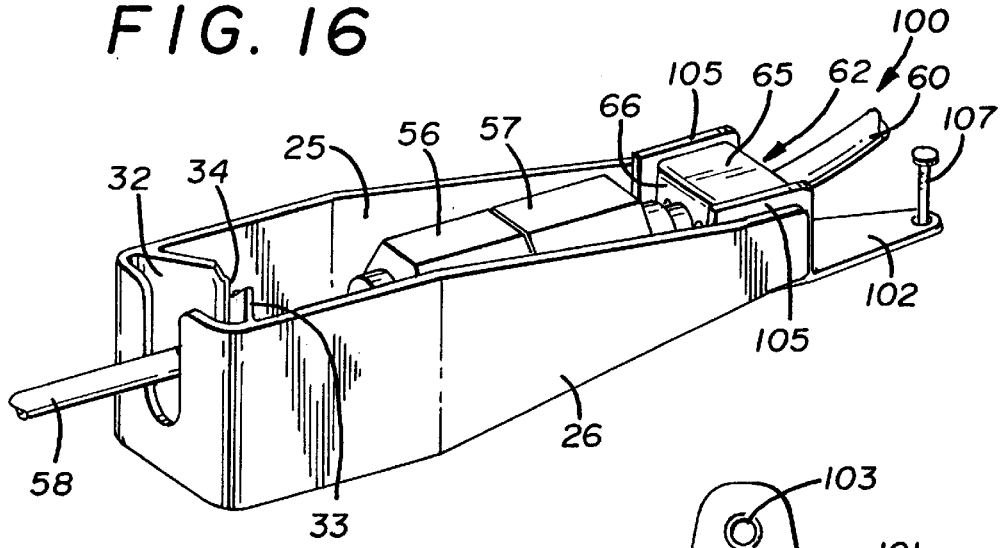
FIG. 17 is a perspective view of an assembled system shown in FIG. 16.
Figure 18:
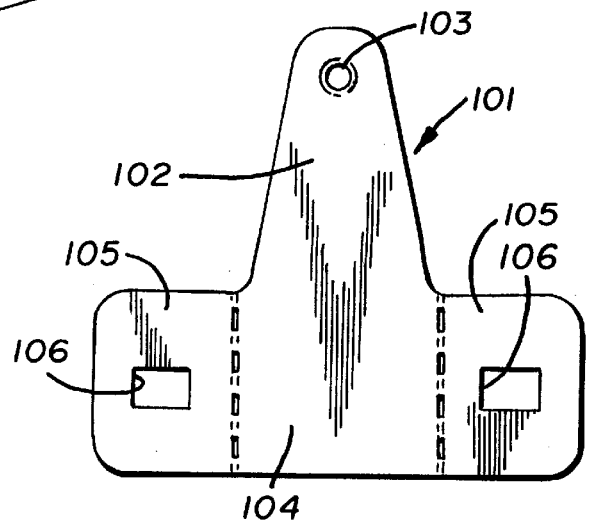
FIG. 18 is a plan view of a cleat shown in a condition prior to being folded and used with the system shown in FIGS. 16 and 17.

FIGS. 16–18 show another application for a system, such as system 55 shown in FIG. 10. Thus, FIGS. 16 and 17 show all of the components previously identified and described relative to FIG. 10, and a description thereof will not be repeated relative to the system generally indicated by the numeral 100 and shown in FIGS. 16–18.

In system 100, cord gripping and coupling system 55 is modified so that it can be readily attached to a surface. Such may be important if a power tool or other device is being utilized on a roof, or the like, where dragging the weight of a long cord and system 55 may not be desirable. Thus, the user may be provided with a plastic cleat, generally indicated by the numeral 101, which, as shown in FIG. 18, may be a flat item having a tab 102 with aperture 103 extending therethrough and a base 104 having wings 105 with apertures 106 therein. Wings 105 may be folded along score lines 107 so that, in use, cleat 101 is configured as shown in FIG. 16, with the wings 105 being oriented perpendicular to tab 102. As such, it can be attached to device 20 in exactly the same fashion that retainer 62 is so attached, that is, lugs 38, 39 may pass through cleat apertures 106 and the parts are then rotated 90° of each other to lock them in place. Of course, as in the other applications, cleat apertures 106 may be replaced by lugs to be utilized with a device 20B. In either situation, system 100 may be attached to a surface, such as a roof, by utilizing a fastener, such as nail 108, positioned through aperture 103 of tab 102. As such, cleat 101 carries the weight of the cord that is on the opposite side of device 20 from the user.

Cleat 101 can be utilized with device 20 in a number of other situations. For example, retainer 62 may not be necessary but rather only cleat 101 need be engaged by arms 25, 26 to perform the function of carrying the weight of the cord. Moreover, cleat 101 and device 20 need not be located at the location of connectors 56 and 57. Rather, device 20 can be located between the user and the location of connectors 56, 57, that is, downstream from the connection, and just the cord will pass through the device 20. But again, with cleat 101 attached to a surface such as a roof, no stress is placed on the connectors 56, 57 and the weight of the cord on the side opposite device 20 from the user is carried by cleat 101.

Device 20 and cleat 101 can be so universally utilized that applications other than use with an electrical cord are available. For example, in situations where a large rope, cable, air line or the like is to be dragged around on a surface, the rope or cable could extend through and be attached to device 20, and device 20 would carry a cleat 101, as just described. When the cleat is then attached to the surface, the only dragging resistance is the length of rope or cable between cleat 101 and the user, the rest of the length of the rope being supported by cleat 101.

In view of the foregoing, it should be evident that a device constructed in accordance with the concepts of the present invention can be adapted for many cord retaining, stress relieving, applications and otherwise accomplishes the objects of the present invention thereby substantially improving the art.

We claim:

1. Apparatus for holding a cord-like member of an electrical connector comprising a retention device adapted to engage another element, said retention device including spaced arms and a grip slot between said arms to engage the cord-like member, one of either the element or both said arms having lugs positioned thereon and the other of either the element or both said arms having apertures therein, said lugs and apertures being of generally the same predetermined shape configuration so that when aligned said lugs can pass through said apertures, and after so doing, can be misaligned so that said device is attached to the element so that said lugs cannot pass through said apertures, wherein the element is a cleat adapted to be affixed to a surface, said cleat including a tab and wings foldable with respect to said tab so that said wings can be oriented perpendicularly to said tab.

2. Apparatus according to claim 1 wherein said tab having an aperture therein and said wings extending away from said tab to engage said arms.

3. Apparatus for holding a cord-like member of an electrical connector comprising a retention device adapted to engage another element, said retention device including spaced arms and a grip slot between said arms to engage the cord-like member, one of either the element or both said arms having lugs positioned thereon and the other of either the element or both said arms having apertures therein, said lugs and apertures being of generally the same predetermined shape configuration so that when aligned said lugs can pass through said apertures, and after so doing, can be misaligned so that said device is attached to the element so that said lugs cannot pass through said apertures, wherein the element is a hinged retainer positionable on another cord-like member.

4. Apparatus according to claim 3 wherein said hinged retainer includes a first section, a second section, and a hinge connecting said first and second sections so that said first and second sections can be folded on each other to engage said another cord-like member.

5. Apparatus according to claim 4, wherein a notch is formed in each section, said notches being formed of a flexible material and when said sections are folded on each other, said notches are opposed to each other and engage said another cord-like member.

6. Apparatus according to claim 4 wherein either a portion of said lugs or a portion of said apertures are formed on each said section so that when said sections are folded on each other, said lugs or said apertures are formed to engage said arms.

7. Apparatus according to claim 4 wherein said first section includes a lug with a lock barb thereon, and said section includes a bar thereon, said lock barb engaging said bar when said sections are folded on each other to hold said sections together and to engage said another cord-like member.

8. Apparatus for holding a cord-like member of an electrical connector comprising a retention device adapted to engage another element, said retention device including spaced arms and a grip slot between said arms to engage the cord-like member, one of either the element or both said arms having lugs positioned thereon and the other of either the element or both said arms having apertures therein, said lugs and apertures being of generally the same predetermined shape configuration so that when aligned said lugs can pass through said apertures, and after so doing, can be misaligned so that said device is attached to the element so that said lugs cannot pass through said apertures, wherein the element is a retainer formed from separate first and second sections which can be joined to engage another cord-like member.

9. Apparatus according to claim 8 wherein each said section includes a generally semicircular notch therein which said notches are adjacent to each other and can engage said another cord-like member when said first section is joined to said second section.

10. Apparatus according to claim 8 wherein either a portion of said lugs or a portion of said apertures are formed on each said section so that when said sections are joined, said lugs or said apertures are formed to engage said arms.

11. Apparatus according to claim 8 wherein said first section includes ribs and a pin near the end of each said rib, said second section including apertures to receive said pins so that said first section may engage said second section.

12. Apparatus according to claim 8 wherein said first section includes ribs and a hook near the end of each said rib, said hooks engaging said second section.

13. Apparatus according to claim 8 wherein opposed lugs are formed on each said section to engage said another cord-like member.

14. Apparatus according to claim 13 wherein said first section has one said lug and said second section has two said lugs spaced from each other such that when said sections are joined, said one said lug is positioned generally midway between said two said lugs to together with said two said lugs engage said another cord-like member.

* * * * *